United States Patent [19]

Tomita et al.

[11] 4,342,301

[45] Aug. 3, 1982

[54] DISTRIBUTOR TYPE FUEL INJECTION PUMP

[75] Inventors: Hitoshi Tomita; Masayoshi Kobayashi, both of Higashi-Matsuyama, Japan

[73] Assignee: Diesel Kiki Co., Ltd., Tokyo, Japan

[21] Appl. No.: 139,739

[22] Filed: Apr. 14, 1980

[30] Foreign Application Priority Data

Apr. 19, 1979 [JP] Japan ..... 54-52283[U]

[51] Int. Cl.[3] ..... F02M 59/34

[52] U.S. Cl. ..... 123/502; 123/364; 123/506

[58] Field of Search ..... 123/502, 501, 365, 387, 123/388, 506, 179 L, 364

[56] References Cited

U.S. PATENT DOCUMENTS

| | | | |
|---|---|---|---|
| 3,726,608 | 4/1973 | Bostwick et al. | 123/501 |
| 3,943,902 | 3/1976 | Skinner | 123/502 |
| 4,220,128 | 9/1980 | Kobayashi | 123/502 |
| 4,273,090 | 6/1981 | Höfer et al. | 123/506 |

FOREIGN PATENT DOCUMENTS

| | | | |
|---|---|---|---|
| 2158689 | 5/1973 | Fed. Rep. of Germany | 123/502 |

*Primary Examiner*—Charles J. Myhre
*Assistant Examiner*—Andrew M. Dolinar
*Attorney, Agent, or Firm*—Frishauf, Holtz, Goodman & Woodward

[57] ABSTRACT

In a distributor type fuel injection pump including a load-responsive pressure adjusting device which is responsive to engine loads for allowing drainage of part of the fuel in the suction chamber of the pump into a zone under lower pressure in the pump when the engine is operated within a predetermined load range, a pressure setting valve is provided in a drainage passage forming part of the pressure adjusting device, which is adapted to open at a predetermined pressure. The pressure setting valve enables establishment of necessary fuel pressure for normal actuation of a fuel injection timing control device provided in the pump within a low engine speed (rpm) range even during operation of the pressure adjusting device.

6 Claims, 5 Drawing Figures

DISTRIBUTOR TYPE FUEL INJECTION PUMP

BACKGROUND OF THE INVENTION

This invention relates to a distributor type fuel injection pump for internal combustion engines, and more particularly to improvements in the fuel injection timing characteristic of such pump within a low engine speed (rpm) range.

A conventional distributor type fuel injection pump for use in a diesel engine is generally provided with a load-responsive pressure adjusting device (hereinafter called "load timer") which is usually located in a centrifugal governor provided in the pump and serves to allow part of the fuel temporarily stored in the fuel suction chamber of the pump to flow into a zone under lower pressure in the pump in response to engine loads, i.e., injected fuel quantities. The drainage of part of the fuel in the suction chamber causes a decrease in the amount of advance of injection timing obtained by a fuel injection timing control device which is provided in the pump and is responsive to fuel pressure in the suction chamber, to retard the moment of injection of fuel into engine cylinders, thus leading to reduced combustion noise as well as reduced temperature in the engine cylinders, the latter of which in turn leads to smaller quantities of NOx produced.

On the other hand, the above-mentioned fuel injection timing control device includes a hydraulically actuatable member which is displaceable in response to a pressure being a function of the engine rpm to vary the moment of injection of the pump. This control device is conventionally provided with a cold starting device (CSD) which is responsive to the pressure being a function of the engine rpm to bias the hydraulically actuatable member in an injection timing advancing direction when the engine operates at speeds below a predetermined engine rpm, to thereby improve the startability of the engine in cold weather. According to this injection timing control device provided with such cold starting device, injection timing control is carried out with an hysteresis characteristic. That is, during the increase of the engine speed, a predetermined amount of injection timing advance is continuously obtained from the start of the engine until a predetermined engine rpm is reached and then a usual injection timing advance action is carried out after the predetermined engine rpm is reached. When the engine speed is decreasing, the timing advance is gradually decreased as the engine speed decreases from a high engine rpm range, and then the timing advance reaches a minimum value in a low engine rpm range including the idling rpm. Due to this injection timing control with an hysteresis characteristic, the engine can be free of knocking noise and murky smoke which would otherwise occur in idling or the like engine conditions.

When this injection timing control device constructed as above is used in combination with the aforesaid type of load timer, it sometimes fails to properly operate so that a predetermined amount of injection timing retard cannot be obtained within the above-mentioned low engine rpm range during decrease of the engine speed, since these two devices are arranged to be operated by a common hydraulic pressure, that is, the fuel pressure in the suction chamber of the fuel injection pump.

OBJECT AND SUMMARY OF THE INVENTION

It is the object of the invention to provide a distributor type fuel injection pump for internal combustion engines which eliminates the above disadvantage and which is capable of carrying out injection timing control without influence of load timer action when the fuel pressure in the suction chamber of the injection pump is below a predetermined value.

According to the invention, a drainage passage which forms part of the load timer device and through which a portion of the fuel in the pump suction chamber drains into a zone under lower pressure in the pump is provided therein with a pressure setting valve which is adapted to open when a predetermined pressure or a higher pressure than the predetermined pressure is applied thereto. The pressure setting valve is kept closed at pressures below the predetermined pressure to thereby maintain the drainage passage blocked so that the injection timing control device is properly operated within a low engine rpm range inclusive of the idling speed range.

The above and other objects, features and advantages of the invention will become more apparent upon reading the ensuing detailed description and the accompanying drawings.

DETAILED DESCRIPTION

Figure 1:
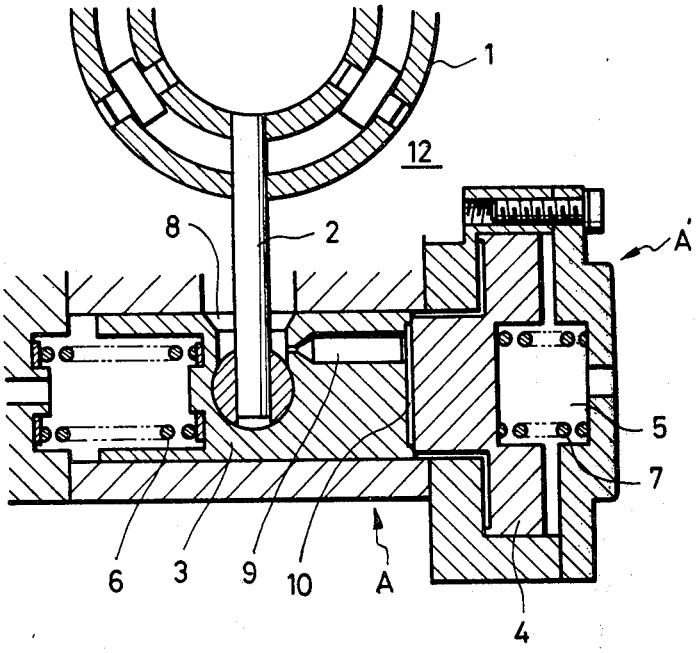
FIG. 1 is a sectional view of an injection timing control device which is provided in a conventional distributor type fuel injection pump as well as in the fuel injection pump according to the present invention.
Figure 3:
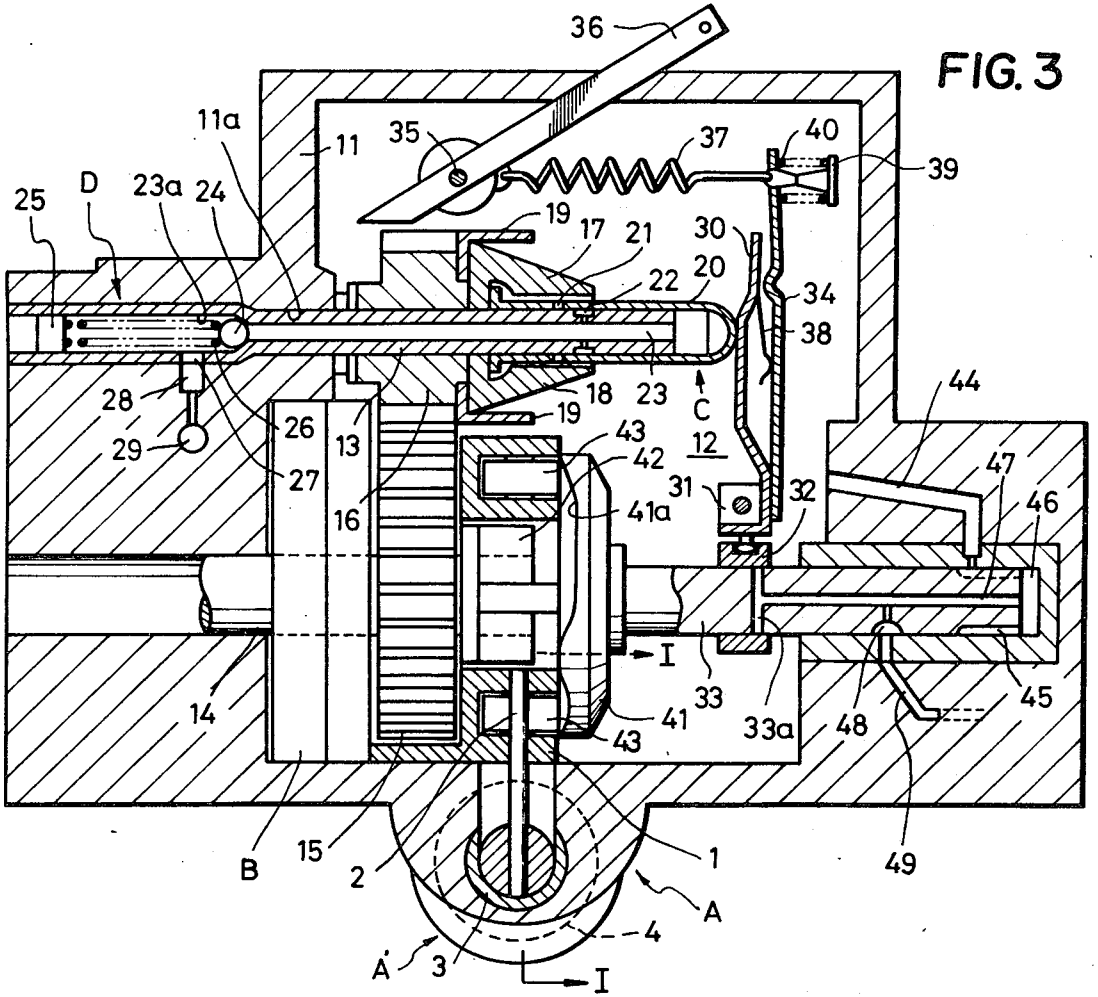
FIG. 3 is a longitudinal sectional view of the distributor type fuel injection pump according to one embodiment of the present invention.

In FIG. 1, symbol A designates an injection timing control device which is conventionally generally used in the aforementioned distributor type fuel injection pump. This device is also used in the distributor type fuel injection pump according to the invention, as shown in FIG. 3 (FIG. 1 is a sectional view taken along line I—I in FIG. 3).

In this injection timing control device, a first piston 3 is coupled to a roller holder 1 through a connecting rod 2, which holder engages with a cam disc, not shown, mounted on a pumping plunger hereinafter referred to. The roller holder 1 is circumferentially displaceable in synchronism with the movement of the piston 3. The piston 3 is provided, at its right side, with a cold starting device A'. More specifically, a second piston 4 with a larger pressure applying area than the first piston 3 is arranged at the right end of the first piston 3. Formed at the right end of the second piston 4 is a chamber 5 which communicates with the atmosphere and in which chamber is positioned a spring 7 having a setting load larger than a spring 6 positioned at the left end of the first piston 3. A hydraulic pressure chamber 10 is defined between the two pistons 3, 4 and is supplied with fuel pressure through passages 8, 9 from a pump suction chamber 12 which in turn is supplied with fuel pressure (fuel feeding pressure) dependent upon the rotational speed (rpm) of an engine associated with the fuel injection pump.

At the start of the engine, the fuel pressure which is supplied into the chamber 10 is nearly zero, with the second piston urged leftward by the spring 7 to bias the first piston 3 in the leftward or injection timing advancing direction, thus obtaining an injection timing advance required for smooth starting of the engine. Then, as the engine rpm increases, the pressure in the chamber 10 increases correspondingly so that the second piston 4 is displaced rightward against the force of the spring 7 until it is kept in its extreme rightward position. When the engine rpm further increases, the first piston 3 starts moving leftward to thus carry out a normal timing advancing action in a high engine rpm range.

Figure 2:
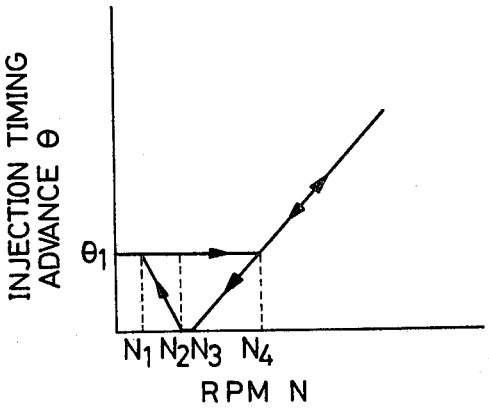
FIG. 2 is a graph showing the timing advance characteristic of the device of FIG. 1.

The injection timing control device of FIG. 1 has an injection timing advance characteristic shown in FIG. 2. When the engine rpm is increasing, the amount of timing advance is maintained at an initial value $\theta 1$ obtained at the start of the engine until a predetermined rpm N4 is reached. The amount of timing advance increases after the rpm N4 is exceeded. When the engine rpm is decreasing, a corresponding drop in the fuel feeding pressure in the suction chamber 12 causes a rightward movement of the piston 3 by the force of spring 6 while the other piston 4 is still kept in its extreme rightward position to obtain a gradually decreasing timing advance, starting from the rpm N4 until a zero amount of timing advance is reached at a predetermined rpm N3. When the fuel feeding pressure is further decreased, the piston 4 starts being leftwardly moved by the force of spring 7 so that the timing advance again increases at rpm N2 and returns to the initial timing advance value O1 at rpm N1.

According to the illustrated injection timing control device, due to this injection timing advance characteristic having an hysteresis loop, excessive injection timing advance is avoided to prevent occurrence of knocking noise and smurky smoke which would othewise be produced within a low engine rpm range including an idling speed range. However, if the aforementioned type load timer operates within such low engine rpm range, the pressure introduced into the hydraulic pressure chamber 10 is so insufficient that the piston 4 urges the piston 3 by the force of spring 7 to keep it in the leftwardly biased or timing advancing direction, thus failing to obtain a necessary reduction in the timing advance within the low engine rpm range.

FIG. 3 shows a distributor type fuel injection pump according to one embodment of the invention. In FIG. 3, like reference characters designate like or corresponding parts to those in FIG. 1. The fuel suction chamber 12 is defined in the housing 11 of the fuel injection pump. A pump drive shaft 14 extends into the suction chamber 12, which shaft is coupled to the output shaft, not shown, of an engine associated with the fuel injection pump. A fuel supply pump B is mounted on the drive shaft 14 for rotation in synchronism therewith to suck fuel from a fuel tank, not shown, and feed it into the suction chamber 12 at a pressure proportional to the engine rpm.

A fixed shaft 13 which forms a support member for a centrifugal governor C is secured in a through bore 11*a* formed in a wall portion of the pump housing 11, with its front half portion projecting into the suction chamber 12. Secured on the projected portion of the fixed shaft 13 is a toothed member 16 which engages with another toothed member 15 secured on the pump drive shaft 14 for rotation therewith. A plurality of flyweights 17, 18 are supported on a flyweight holder 19 mounted on the toothed member 16 for radial swinging motion. Further fitted on the fixed shaft 13 is a sleeve 20 which is slidable on the shaft 13 in response to radial swinging motion of the flyweights 17, 18. The sleeve 20 and the fixed shaft 13 have predetermined peripheral portions thereof formed therein with ports 21 and 22, respectively. The fixed shaft 13 also has an axial bore 23 extending therein and communicating with the port 22. This axial bore has a slightly expanded portion 23*a* located at a rear portion of the fixed shaft 13 in which a pressure setting valve D is received. That is, a ball 24 is seated against a front end inner surface of the expanded portion 23*a* by the force of a coil spring 26 interposed between the ball 24 and a spring seat 25 fitted in the expanded portion 23*a*.

Bores 27 and 28 are formed, respectively, in the rear peripheral wall of the fixed shaft 13 and a corresponding portion of the through bore 11*a* in the housing 11, and in communication with each other. The interior of the expanded portion 23*a* of the axial bore 23 communicates through these bores 27, 28 with a passage 29 formed in the housing 11 and leading to a zone under lower pressure.

A starting lever 30 is pivotally supported on a support member 31, and a control sleeve 32 is fitted on the pumping plunger 33 for sliding thereon in response to pivotal motion of the starting lever 30. The starting lever 30 is in engagement with a tension spring 37 through a starting spring 38 and a tension lever 34 both secured to the starting lever 30, in a fashion being urged against the tip of the sleeve 20 by the force of spring 37. The tension spring 37 has its setting load adjustable by means of a control lever 36 pivoted to a fixed support 35 and coupled to an external operating mechanism, not shown. The tension lever 34 has its free end urged by an idling spring 40 seated against a spring seat 39 which is pulled by the tension spring 37.

Integrally secured on the pumping plunger 33 at its left end is a cam disc 41 which engages with the pump drive shaft 14 through an Oldham coupling 42 and has a camming surface 41*a* urged, by the force of a spring not shown, against rollers 43 carried on the roller holder 1 which is allowed for pivotal movement through a limited angle. The pumping plunger 33 which is integral with the cam disk 41 is therefore forced to make a rotating and reciprocating motion as the drive shaft 14 rotates, to suck fuel in the suction chamber 12 into a pump working chamber 46 through a passage 44 and grooves 45 and feed it to engine cylinders, not shown, through a central channel 47, a distributing groove 48, outlet channels 49, delivery valves and injection nozzles, the latter two not being shown. The roller holder 1 is in engagement with the first piston 3 of the injection timing control device A through the connecting rod 2 as previously described with reference to FIG. 1.

With this arrangement, when the drive shaft 14 rotates at speeds dependent upon the engine rpm, the flyweight holder 19 and accordingly the flyweights 17, 18 rotate through the toothed members 15, 16 to displace the sleeve 20 axially of the fixed shaft 13. This axial displacement of the sleeve 20 causes a displacement of the control sleeve 32 by way of he starting lever 30 which in turn causes a change in the duration of engagement of the control sleeve 32 with a cut-off port 33*a* formed in the plunger 33 during the delivery stroke of the plunger 33, resulting in a corresponding change in the fuel injection quantity. During the axial movement of the sleeve 20, when the port 21 in the sleeve 20 registers with the port 22 in the fixed shaft 13, fuel in the suction chamber 12, which is supplied with fuel from the fuel supply pump B at an rpm dependent pressure, is partially introduced into the channel 23 in the fixed shaft 13 through the registered ports 21, 22 and travels therein toward the ball 24 forming part of the pressure setting valve D. When the fuel feeding pressure exceeds the setting load of the spring 26, it moves the ball 24 against the force of the spring 26 to open the pressure setting valve D and accordingly, fuel is allowed to escape through the valve D, the bores 27, 28 formed in the fixed shaft 13 and the housing 11 and the channel 29 into the lower pressure zone in the injection pump.

Figure 4:
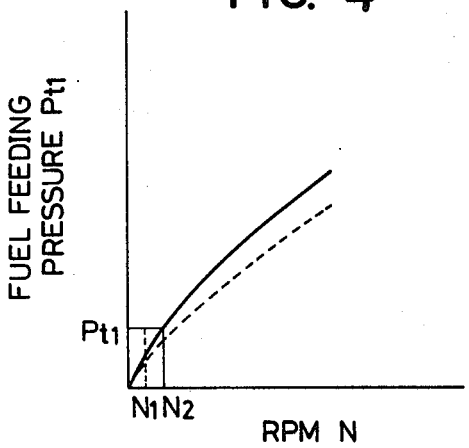
FIG. 4 is a graph showing the fuel feeding pressure characteristic obtained by a conventional load timer.
Figure 5:
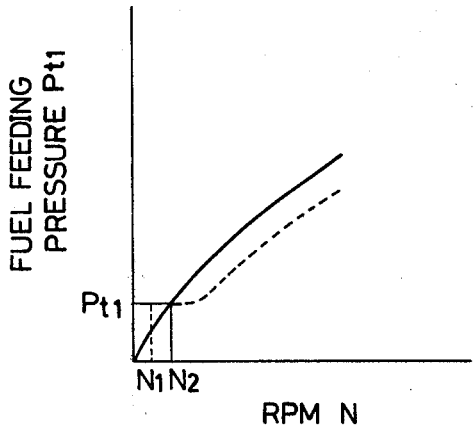
FIG. 5 is a graph showing the fuel feeding pressure characteristic obtained by the load timer according to the present invention.

The ports 21 and 22 of the load timer are located so as to register with each other when the engine operates within a medium load range in which NOx is produced at a relatively high rate. However, if the setting load of the tension spring 37 is small, dependent upon the position of the control lever 36 in idling or the like operation, the ports 21 and 22 register with each other over a wide rpm range so that the load timer operates even within a low rpm range including the idling speed. As a consequence, the fuel feeding pressure in the suction chamber 12 which is obtained when the load timer is operating becomes lower at a certain low rpm N1 as indicated in broken line in FIG. 4 with respect to the pressure curve indicated in solid line which is obtained when the load timer is not operating. Accordingly, a required fuel feeding pressure cannot be obtained at idling rpm N2 so that the injection timing control device shown in FIG. 1 fails to obtain its desired timing advance in such low rpm range as previously mentioned. Therefore, according to the invention, in order for the illustrated injection timing control device A to have such a desired timing advance characteristic, the valve opening pressure of the pressure setting valve D is set at a value such that the valve does not open within the above-mentioned low rpm range. If the pressure setting valve according to the invention is used in combination with the injection timing control device, as shown in FIG. 5, a fuel feeding pressure Pt1 necessary for normal operation of the injection timing control device can be obtained at idling rpm N2 even when the load timer is operating as indicated in broken line, like the fuel feeding pressure curve obtained when the load timer is not operating as indicated in solid line.

The moment at which the load timer commences to operate, with respect to the engine rpm, can be freely varied by changing the urging force (setting load) of the spring 26 of the pressure setting valve D in accordance with the working conditions and the specifications of the fuel injection pump and the injection timing control device which are used together with the load timer. To this end, the spring seat 25 for the spring 26 may be adjustable in position.

Although, in the illustrated embodiment, the pressure setting valve D is located in the fuel drainage passage 23 formed in the fixed shaft 13 of the centrifugal governor C, it can be located in any drainage passage provided for the load timer, for instance, in the channel 27, instead. Further, the pressure setting valve D is not limited to a ball valve type as illustrated, but other types of valves may be used.

While a preferred embodiment of the invention has been described, such description is for illustrative purposes only, and it is to be understood that changes and variations may be made without departing from the spirit and scope of the following claims.

What is claimed is:

1. In a fuel injection pump for an internal combustion engine, said fuel injection pump being of the type including (a) a housing defining therein a fuel suction chamber, (b) fuel supply means for supplying fuel into said suction chamber at a pressure which is a function of the engine rpm, (c) pump means for supplying fuel in an injecting manner to the engine, (d) an engine rpm governor having a displaceable member which is displaceable as a function of the engine rpm, (e) means connecting said displaceable member of said governor to said pump means for varying the injection quantity of the latter, (f) injection timing control means having a member connected to said pump means and which is displaceable in response to a change in the pressure in said suction chamber for varying the timing of injection of the fuel injection pump, and (g) bias means responsive to the pressure in said suction chamber for biasing said member of said injection timing control means in an injection timing advancing direction after the engine starts and until said pressure in said suction chamber reaches a predetermined value, the improvement comprising:

A. a first piston forming said member of said injection timing control means, said first piston being displaceable in response to the pressure in said suction chamber, the position of said first piston determining the timing of injection of the fuel injection pump;

B. a first spring forming part of said injection timing control means and arranged to urge said first piston in an injection timing retarding direction;

C. a second piston forming part of said bias means and having a pressure applying area larger than that of said first piston, said second piston being responsive to the pressure in said suction chamber for biasing said first piston in an injection timing advancing direction after the engine starts and until said pressure in said suction chamber reaches said predetermined value;

D. a second spring forming part of said bias means and having an urging force which is larger than that of said first spring, said second spring being arranged to urge said second piston to cause it to bias said first piston in an injection timing advancing direction;

E. means extending into said suction chamber and defining a drainage passage leading from said suction chamber to a zone under a lower pressure than the pressure in said suction chamber;

F. drainage control means forming part of said displaceable member of said governor and adapted to control the drainage of fuel through said drainage passage as a function of the position of said displaceable member of said governor; and G. a valve disposed in said drainage passage downstream of said drainage control means and controlling the flow of fuel received from said drainage control means, said valve being adapted to open at a predetermined pressure of fuel flowing in said drainage passage corresponding to an engine rpm which exceeds a lower engine rpm including idling rpm;

whereby said drainage passage is blocked by said valve unless said predetermined valve opening pressure of said valve is exceeded by the pressure of fuel flowing in said drainage passage, to thus keep fuel from escaping from said suction chamber to said lower pressure zone.

2. The fuel injection pump as claimed in claim 1, wherein said displaceable member of said governor is slidably mounted on a fixed shaft, said drainage passage extending in said fixed shaft axially thereof.

3. The fuel injection pump as claimed in claim 2, wherein said drainage passage has an expanded portion in which said valve is located.

4. The fuel injection pump as claimed in claim 3, wherein said valve includes a valve body, spring and a spring seat, said expanded portion of said drainage passage having one end thereof serving as a valve seat for said valve body, said valve body being urged against said valve seat by said spring.

5. The fuel injection pump as claimed in claim 4, wherein said spring seat is adjustable in position to thereby vary the set force of said spring.

6. In a fuel injection pump for an internal combustion engine, said fuel injection pump being of the type including (a) a housing defining therein a fuel suction chamber, (b) fuel supply means for supplying fuel into said suction chamber at a pressure which is a function of the engine rpm, (c) pump means for supplying fuel in an injecting manner to the engine, (d) an engine rpm governor having a displaceable member which is displaceable as a function of the engine rpm, (e) means connecting said displaceable member of said governor to said pump means for varying the injection quantity of the latter, (f) injection timing control means having a member connected to said pump means and which is displaceable in response to a change in the pressure in said suction chamber for varying the timing of injection of the fuel injection pump, and (g) bias means responsive to the pressure in said suction chamber for biasing said member of said injection timing control means in an injection timing advancing direction after the engine starts and until said pressure in said suction chamber reaches a predetermined value, the improvement comprising:

A. a first piston forming said member of said injection timing control means, said first piston being displaceable in response to the pressure in said suction chamber, the position of said first piston determining the timing of injection of the fuel injection pump;

B. a first sping forming part of said injection timing control means and arranged to urge said first piston in an injection timing retarding direction;

C. a second piston forming part of said bias means and having a pressure applying area larger than that of said first piston, said second piston being responsive to the pressure in said suction chamber for biasing said first piston in an injection timing advancing direction after the engine starts and until said pressure in said suction chamber reaches said predetermined value;

D. a second spring forming part of said bias means and having an urging force which is larger than that of said first spring, said second spring being arranged to urge said second piston to cause it to bias said first piston in an injection timing advancing direction;

E. a fixed shaft extending into said suction chamber and defining therein a drainage passage leading from said suction chamber to a zone under a lower pressure than the pressure in said suction chamber;

F. flyweights forming part of said governor, said flyweights being mounted on said fixed shaft for displacement as a function of the engine rpm;

G. a sleeve member forming said displaceable member of said governor, said sleeve member being displaceable in response to displacement of said flyweights;

H. port means formed in peripheries of said fixed shaft and said sleeve member, said port means being responsive to displacement of said sleeve member to allow fuel to flow from said suction chamber into said drainage passage at a predetermined engine rpm range; and I. a valve disposed in said drainage passage and adapted to open at a predetermined pressure of fuel flowing in said drainage passage.

* * * * *